US011680395B2

(12) United States Patent
Li

(10) Patent No.: US 11,680,395 B2
(45) Date of Patent: Jun. 20, 2023

(54) APRON SINK RETROFIT CABINET KIT

(71) Applicant: COMPASS MANUFACTURING INTERNATIONAL, LLC, Louisville, KY (US)

(72) Inventor: DeChang Li, Maspeth, NY (US)

(73) Assignee: Compass Manufacturing International, LLC, Louisville, KY (US)

( * ) Notice: Subject to any disclaimer, the term of this patent is extended or adjusted under 35 U.S.C. 154(b) by 0 days.

(21) Appl. No.: 16/559,523

(22) Filed: Sep. 3, 2019

(65) Prior Publication Data

US 2020/0102727 A1 Apr. 2, 2020

Related U.S. Application Data

(63) Continuation-in-part of application No. 29/651,583, filed on Sep. 29, 2018, now Pat. No. Des. 914,170, which is a continuation-in-part of application No. 29/620,417, filed on Dec. 2, 2016, now abandoned, and a continuation-in-part of application No. 29/620,418, filed on Dec. 2, 2016, now abandoned.

(60) Provisional application No. 62/726,028, filed on Aug. 31, 2018.

(51) Int. Cl.
*E03C 1/182* (2006.01)
*A47B 77/06* (2006.01)

(52) U.S. Cl.
CPC ..... *E03C 1/182* (2013.01); *A47B 77/06* (2013.01)

(58) Field of Classification Search
CPC ... E03C 1/18; E03C 1/182; E03C 1/33; E03C 1/335; E03C 1/14; E03C 1/16; A47B 77/06
USPC ..... D23/284, 286, 290, 287, 285, 272–274, D23/303, 307, 292–293.1
See application file for complete search history.

(56) References Cited

U.S. PATENT DOCUMENTS

| | | | | | |
|---|---|---|---|---|---|
| D313,068 | S | * | 12/1990 | Kohler, Jr. | D23/293.1 |
| D353,652 | S | * | 12/1994 | Dannenberg | D23/290 |
| D358,457 | S | * | 5/1995 | Dannenberg | D23/293.1 |
| D492,983 | S | | 7/2004 | Rachiele | |
| D498,520 | S | * | 11/2004 | Rachiele | D23/290 |
| D501,541 | S | * | 2/2005 | Gordon | D23/284 |
| 7,246,387 | B2 | * | 7/2007 | Erickson | A47B 77/06 4/631 |
| D700,301 | S | | 2/2014 | Rachiele | |
| RE45,142 | E | | 9/2014 | Kehrer | |
| 8,844,070 | B2 | | 9/2014 | Booth | |
| 9,173,487 | B2 | * | 11/2015 | Booth | E03C 1/18 |
| 9,492,010 | B2 | | 11/2016 | Booth | |
| 9,492,011 | B2 | | 11/2016 | Booth | |
| 10,092,097 | B2 | * | 10/2018 | Booth | E03C 1/18 |
| 10,098,455 | B2 | * | 10/2018 | Booth | E03C 1/33 |

(Continued)

*Primary Examiner* — Erin Deery
(74) *Attorney, Agent, or Firm* — Carrithers Law Office, PLLC

(57) ABSTRACT

An apron sink kit is provided for installing an apron sink in a pre-existing cabinet. The sink includes at least one basin with rims extending outward from the top edges of the left and right walls and the front and back walls. An apron extends downward from the outer edge of the front wall rim and for a selected length along the sides of the sink. The sink is vertically supported by a cabinet rail under the apron and by the back and side edges of the counter top for top mounting or mounting underneath a cabinet top.

11 Claims, 10 Drawing Sheets

(56) References Cited

U.S. PATENT DOCUMENTS

| | | | | |
|---|---|---|---|---|
| 10,125,481 | B2 * | 11/2018 | Booth | E03C 1/33 |
| 10,130,172 | B2 * | 11/2018 | Booth | A47B 77/06 |
| 10,130,173 | B2 * | 11/2018 | Booth | E03C 1/33 |
| 10,226,122 | B2 * | 3/2019 | Booth | A47B 77/06 |
| D867,555 | S * | 11/2019 | Huang | D23/284 |
| 2005/0223486 | A1 | 10/2005 | Jumalon | |
| 2012/0222211 | A1 | 9/2012 | Booth | |
| 2012/0222212 | A1 | 9/2012 | Booth | |
| 2015/0074902 | A1 | 3/2015 | Lyons | |
| 2017/0037606 | A1 | 2/2017 | Booth | |
| 2017/0138029 | A1 | 5/2017 | Booth | |
| 2017/0138031 | A1 | 5/2017 | Booth | |

* cited by examiner

APRON SINK RETROFIT CABINET KIT

CROSS REFERENCES TO RELATED APPLICATIONS

This application claims priority from U.S. Provisional Application Ser. No. 62/7262,028 filed on Aug. 31, 2018 and U.S. Design Application Ser. No. 29/651,583 filed on Sep. 29, 2018 which is a continuation in part of U.S. Design application Ser. No. 29/620,417 and Ser. No. 29/620,418 filed on Dec. 2, 2016, all of which are incorporated by reference in its entirety.

TECHNICAL FIELD

The present invention relates to the field of sinks primarily used in kitchens and laundries.

BACKGROUND OF THE INVENTION

Sinks in general and farmhouse sinks in particular require vertical support which is generally provided by the counter top mounted on the top of the cabinet. Most sinks include at least one basin with four walls and a bottom with a drain hole. The top outside edges of the basin have an outward extending rim for attachment to a flat counter top on the cabinet.

An apron sink has an added feature which is a front panel extending laterally across the front portion of the sink. The downward extending apron extends laterally from one side of the sink to the other and from the top edge of the front rim downward to a bottom edge by a selected length. The apron usually includes a bottom surface and side surface extending horizontally backward from the bottom edge. An opening is generally made in the counter top which is sized to receive and support the left, right and rear rims of the sink. The rims are mounted either on top of the flat counter top. The sink can be mounted such that a rim of the sink rests on a counter top of a cabinet and is referred to as a self-rimming installation. A sink may mounted in a manner so that the rim of the sink is located below the counter top is generally referred to as under-counter mounted or under-mounted sink.

It is often difficult to install apron-front sinks into standard, stock, or off-the-shelf non-apron-front cabinetry due to the width of the sink and the height of a conventional cabinet which include a 36 inch sink base having a pair of side by side six "6" inch opening drawer panels positioned below the cabinet top and above a pair of opposing doors or a pair of side by side eight "8" inch drawers positioned below the cabinet top and above a pair of opposing doors. Retrofits require modifications to the cabinet and counter top or installation of a larger apron sink for conventional sink which sets in a cutout portion of the counter top.

U.S. Pat. No. 10,092,097 for an Apron-Front Sink Assembly by Booth et al.; U.S. Pat. No. 10,226,122 for an Apron-Front Sink by Booth et al.; U.S. Pat. No. 10,130,172 for an Apron-Front Sink Assembly by Booth et al.; U.S. Pat. No. 9,173,487 for an Apron-Front Sink by Booth et al.; U.S. Pat. No. 9,137,487 by Booth et al, U.S. Patent Publication 2017/0037606 for a Mounting System for Sink by Booth et al.; U.S. Patent Publication 2017/0138031 for a Method of Installing Apron-Front Sink by Booth et al.; U.S. Patent Publication 2017/0138032 for a Method of Installing Apron-Front Sink by Booth et al.; U.S. Patent Publication 2017/0138029 for a Sink and Cabinet Assembly by Booth et al.; U.S. Pat. No. 9,995,026 for a Mounting System for ink by Booth et al. teach a sink with a basin with outward extending rims and an apron extending downward from the front rim, wherein the left and right rims are attached to and supported by supporting framework within the cabinet walls.

U.S. Pat. No. 3,142,295 teaches an Installation Means for built-In Range by Blee, and U.S. Design Patent No. 353652 by Dannenburg teaches a sink with a basin, rims and an apron.

SUMMARY OF THE INVENTION

In accordance with the present invention, there is provided a farmhouse sink with at least one basin including a left wall, a rear wall, a right wall, a front wall, a bottom with a drain hole.

The sinks are designed to replace conventional sinks and be installed in existing prefabricated or conventional cabinets typically about 36 inches wide to provide the appearance of a traditional apron front or farmhouse sink utilizing the lateral cross member extending between the cabinet walls above the cabinet doors and below the fake drawer panels eliminating the requirement for side supports extending from the front of the sink cabinet to the rear wall of the sink cabinet to support the sides of the sink and eliminating the need for a center member to extend between the front vertical member extending between the cabinet door and a rear wall of the cabinet. The sink may have any number of basins. The apron, which is coupled to the front wall of the basin rim, extends downwardly from the rim and laterally between a first end and a second end to define a front portion of the sink. The first and second ends of the apron extend laterally beyond the outer periphery of the rim associated with each corresponding side wall. Extending the ends of the apron past the outer periphery of the rim may allow the ends of the apron to at least partially overlap a face of the cabinetry to conceal possible cut lines and/or openings in the face of the cabinetry.

The present invention provides a sink kit and method of installation of an apron sink including a basin having a first side wall, an opposite second side wall and a front wall and rim supported at and extending outwardly from an upper end of the first and second side walls in a substantially horizontal orientation. First and second side flanges or side panels extend from the front apron panel downward from the rim parallel and spaced apart from the corresponding first and second side walls a selected distance. A bottom apron flange extends from the front bottom edge of the front panel to the side flanges rearwardly an effective length to abut or to extend over the front lateral frame cross member of the sink cabinet. The front end of the apron can extend outwardly past the front face of the cabinet a selected distance.

The rim extending horizontally outwardly from the top edges of the sink side and rear walls projecting to the apron panel in the front portion of the sink and to the side flanges. The rear rim has a selected number of holes for mounting plumbing fixtures such as faucets, valves and soap dispensers. The vertical height of the front side is a selected height based on the dimensions of a given cabinet intended to hold the sink.

Extending downward from the outer edge of the right rim is the right side flange of the apron. The side flanges extend laterally from the right edge of the apron front rearwardly for a selected length and downward from the sink rim to a point about even with the bottom of the sink.

The apron may be mounted with the front of the apron panel flush with the front of the cabinet or having a portion of the apron extending pass the front of the cabinet so that the front panel of the apron and portion of the side flanges extend outward pass the front surface of the cabinet. The side flanges extend rearward laterally from the side edges of the apron panel an effective distance rearwardly to abut a notch formed in the counter top or extend past the front of the cabinet eliminating any gaps there between. The front bottom portion of the sink and more preferably the bottom portion of the apron extending a selected length rearwardly from the front apron panel between the side panels rests on the top surface of the lateral front cross frame member extending between the cabinet walls above the sink doors and below the drawers.

One preferred embodiment of an apron sink retrofit cabinet kit, comprises or consists of at least one basin including a left wall, a rear wall, a right wall, a front wall and a floor with a drain hole. The left wall has a left rim extending horizontally outward from a top edge of the left wall and the rear wall has a rear rim extending horizontally outward from a top edge of the rear wall. The right wall has a right rim extending horizontally outward from a top edge of the right wall and a front wall having a front rim extending horizontally outward from a top edge of the front wall. The rear rim has a selected number of apertures formed therein for mounting plumbing fixtures. A bottom surface of the rear rim has a U-channel running along an outer edge of the rear rim. An open side of the U-channel faces downward and a front edge of the front rim has a front side of an apron extending downward therefrom. The front side of the apron extends laterally from a left end to a right end of the edge of the front rim. The front side extends downward a selected depth typically about the same depth as the sink depth and a bottom edge of the front side of the apron has a bottom flange extending horizontally rearward from a right lower corner to a left lower corner of the front side by a selected distance. An outer edge of the right rim has a right side extending downward and the right side extends laterally from a right edge of the front side a selected distance toward a rear end of the outer edge of the right rim. A first portion of the right side flange of the apron extends downward from the outer edge of the right rim to a right edge of the bottom sink and a second portion of the right side flange extends from the outer edge of the right rim downward a selected depth. An outer edge of the left rim has a left side flange extending downward and the left side flange extends laterally from a left edge of the front side flange a selected distance to a rear end of the outer edge of the left apron rim. A first portion of the right side flange of the apron extends downward from the outer edge of the left rim to a left edge of the bottom side flange, and a second and portion of the left side flange extends from the outer edge of the left rim downward at selected depth.

The method of retrofitting and replacing a conventional sink in a cabinet with an apron sink comprises or consists of the steps of selecting an apron sink as described heretofore, and removing the existing sink; removing the false drawer fronts and the top rail so that only the rail which forms the under sink door frame remains; trimming the existing opening in the counter top on the right and left sides to a width forming an effective gap of about one-sixteenth inch wider than the distance from the outside lateral surface of the left side to the outside lateral surface of the right side; placing a bead of a plumber's putty sealer on the top surface of the rear edge of the opening; placing a bead of silicone caulk on the center of the top side of the cabinet rail in the opening; placing the apron sink in the opening with the bottom surface of the rear rim resting on the rear edge of the opening and with the u-channel pressed against the rear edge of the opening; placing the bottom side of the apron on top of the cabinet cross member in the opening; attaching the U-channel to the rear edge of the opening in the counter top; and applying a bead of silicone caulk to the junction of the apron and the counter top on both the left and the right sides.

It is an object of this invention to provide the sink described above which also includes partial outer sides which extend downward from the outer edges of the left and right rims.

It is an object of this invention to provide a farmhouse sink as described above which is vertically supported at the rear rim and under the apron without support under the left or right side rims.

It is an object of the present invention to provide an apron sink which includes a flat front apron or a convex or outwardly curved front apron panel.

It is an object of the present invention to provide a rectangular front panel apron sink having a 7 and ½ inch depth apron depth and 8 inch bowl which fits into a cabinet having a 6 inch depth opening with the drawer panel removed and 1 and ½ inch flat counter top.

It is an object of the present invention to provide a curved front panel apron sink having a 8 inch depth apron depth and 8 inch bowl which fits into a cabinet having a 6 inch depth opening with the drawer panel removed.

It is an object of the present invention to provide an apron sink which fits into a cabinet having an 8 inch depth opening.

It is an object of the present invention to provide a method of retrofitting an apron sink into a conventional cabinet having a 30-48 inch sink base.

It is an object of the present invention to provide an apron sink insert having a front portion setting on and supported by the front horizontal rail cross member upon removal of fake drawer panels from the cabinet.

It is an object of the present invention to provide an apron sink which is top mounted and installed in existing laminate top counters and slides in after removing the real or fake drawer panels of a cabinet.

It is an object of the present invention to provide an apron sink wherein the front of the apron sink extends flush with or outwardly past the front plan surface of the cabinet face after installation.

It is an object of the present invention to provide an apron sink which is supported by the front horizontal rail cross member upon removal of fake drawer panels from the cabinet and does not require side support rails to support the sink in addition to the cabinet top.

It is an object of the present invention to provide a retrofit apron sink that fits in conventional generic and/or prefabricated cabinets with flat laminate counter tops.

It is an object of the present invention to include a method of installing apron sinks having u-channels formed on the outer bottom surface of the sink rim for using clips and fasteners to provide support for the side and rear rims of the sink to the counter top.

It is an object of the present invention to provide cut out templates for cutting a pattern out of the counter top for installation of the apron sink and faucet hardware.

It is an object of the present invention to include a side notch in the template to abut the rear end of the side flanges of the apron extending from the front panel of the apron.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
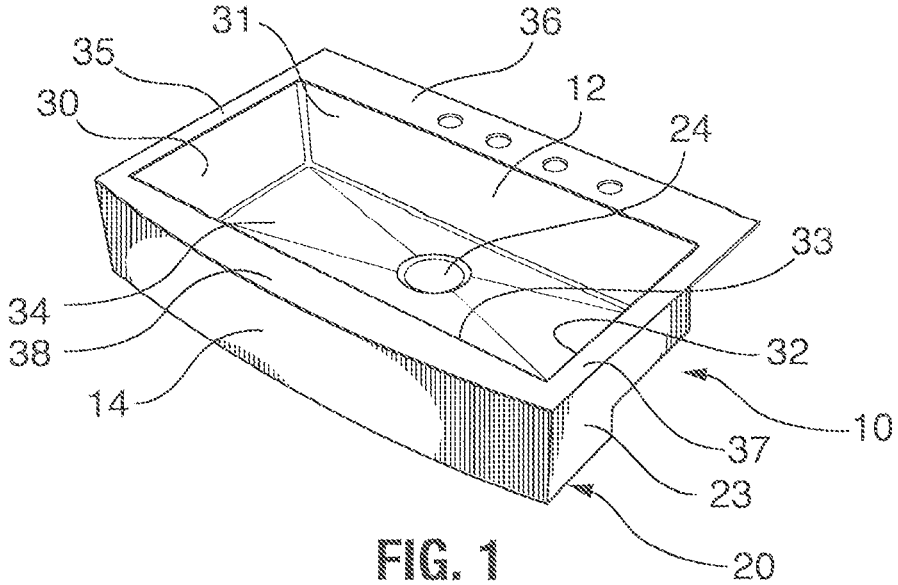
FIG. 1 is a perspective view of an apron sink having a curved front apron panel portion and long apron side flanges extending rearward a selected distance flush with the face of the front apron and contiguous with the edges of the side rims of the sink.
Figure 2:
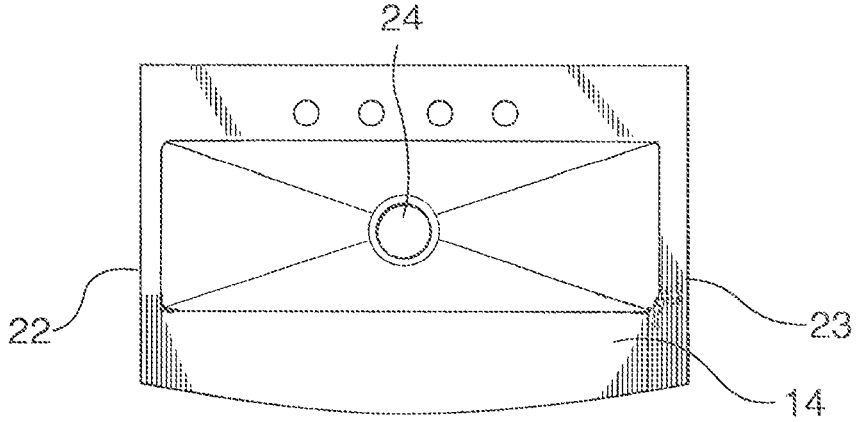
FIG. 2 is a top view of the apron sink of FIG. 1.
Figure 3:
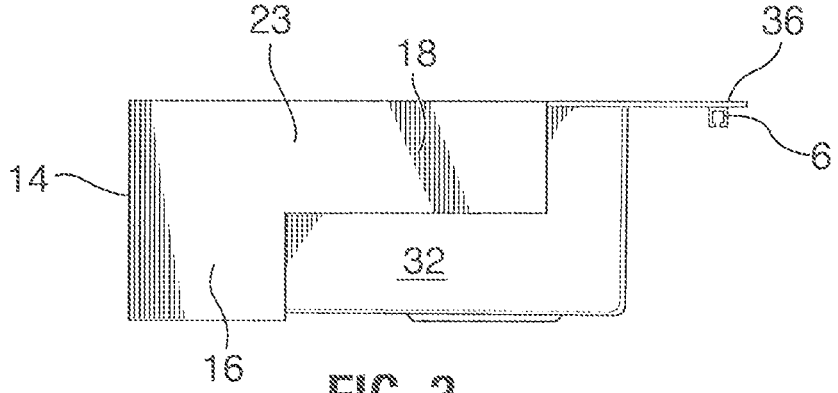
FIG. 3 is a right hand view of the apron sink of FIG. 1 showing the left apron side flange and left sink sidewall, the rear portion of the top apron, and rear U-channel disposed beneath the rear rim.
Figure 4:
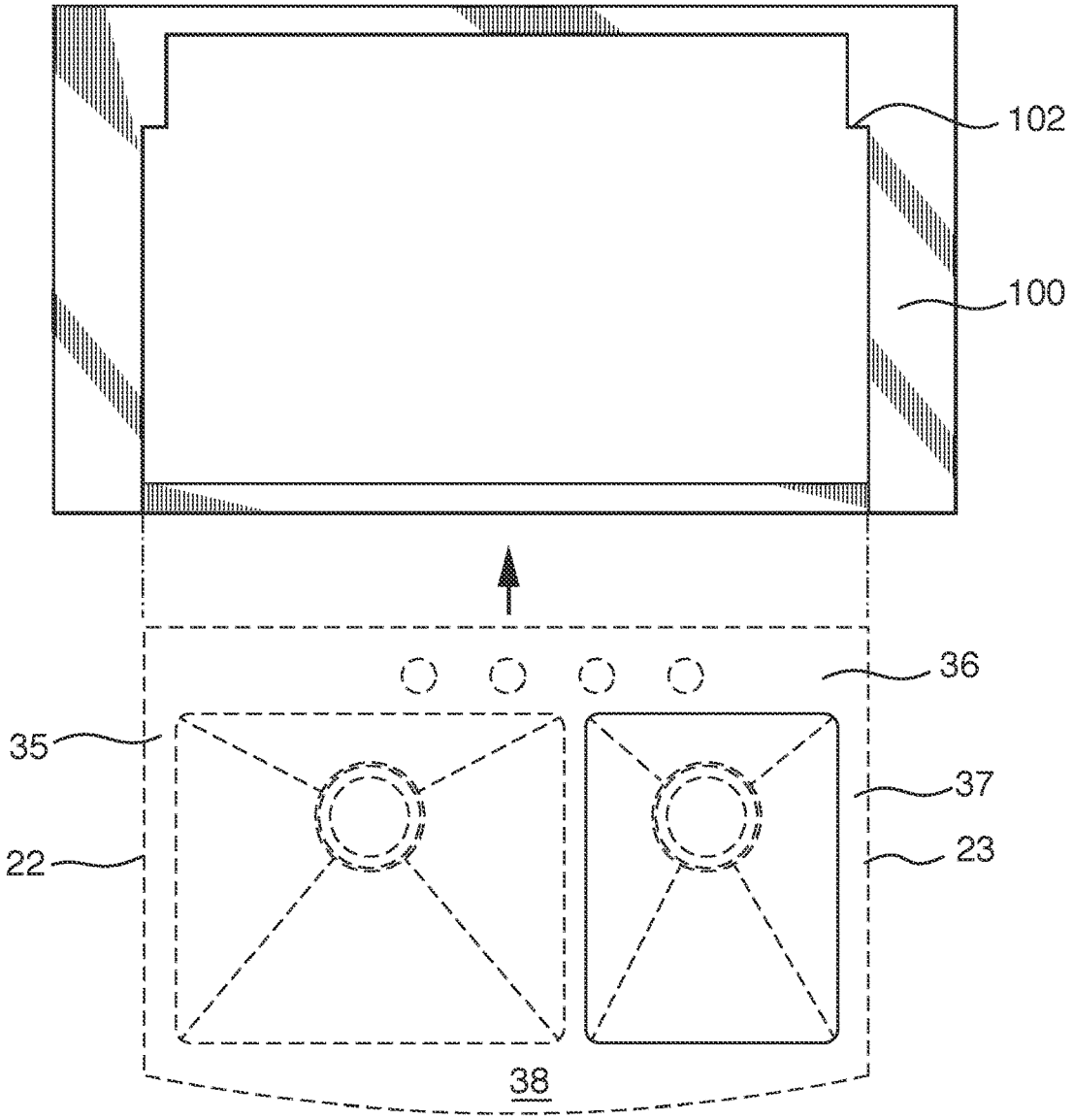
FIG. 4 is a top view of an apron sink of FIG. 1 aligned with a counter top showing the apron side flanges for abutting the notch in the cabinet top and showing the cabinet cross member for supporting the front portion of the apron sink.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly. References to "front," "back," "rear," "upper," "lower," "right," and "left" are used to identify the various elements to a user facing the sink, and with "lateral" being left-right.

It should further be noted that for purposes of this disclosure, the term coupled means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the term "about" can be reasonably appreciated by a person skilled in the art to denote somewhat above or somewhat below the stated numerical value, to within a range of ±10%.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

In accordance with the present invention, there is provided an apron sink 10 with at least one basin 12 including a left wall 30, a rear wall 31, a right wall 32, a front wall 33, a floor 34 having a floor top surface 133 and floor bottom surface 134 with a drain hole 24. Each of the sink side walls 30, 31, 32 and 33 extend outwardly forming a rim 29 have a horizontal lip or rim defined as left side rim 35, rear rim 36, right side rim 37 and front rim 38 respectively extending normal therefrom and generally horizontally outward from the top edges of the sink walls. The bottom surface of the rims are designated as left side rim bottom surface 135, rear rim bottom surface 136, right side rim bottom surface 137 and front rim bottom surface 138 respectively. A rear rim 36 has a selected number of spaced apart openings there through for mounting plumbing fixtures such as faucets, valves and soap dispensers in cooperative engagement therewith.

Figure 13:
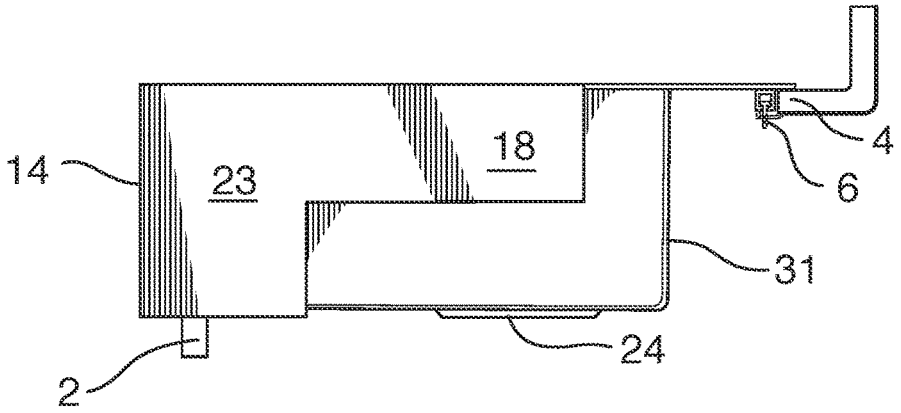
FIG. 13 is a left side view of the farmhouse apron sink of FIG. 1 showing the cabinet front cross member support brace positioned above the cabinet doors and below the drawer panels and the rear lip of the cabinet counter top supporting the rear rim of the sink.
Figure 17:
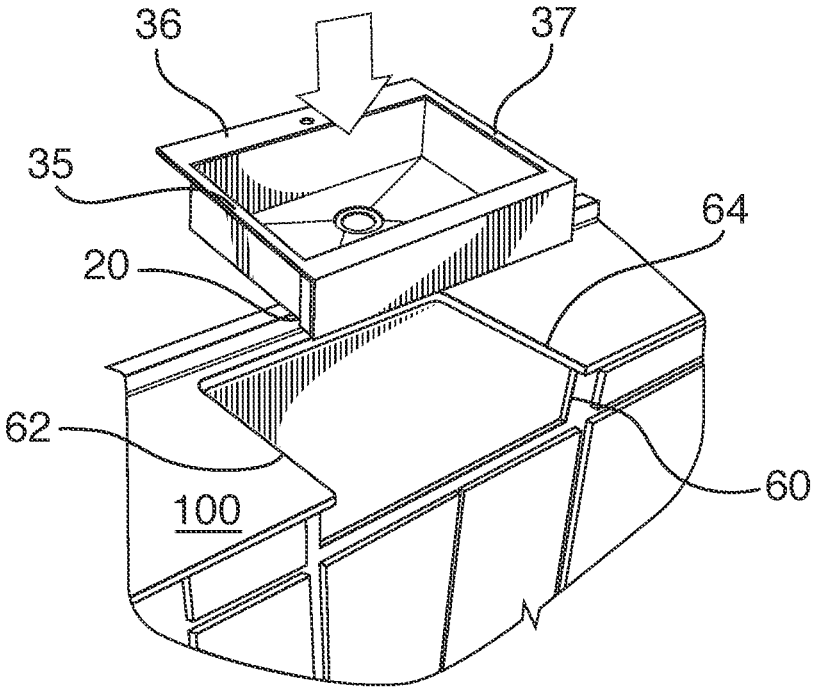
FIG. 17 shows an perspective view of the installation of a apron sink in a cabinet including a cutaway portion of the counter top whereby the apron rests on the cross member support over the doors and the rear rim and side rims of the apron sink are supported by the counter top.
Figure 18:
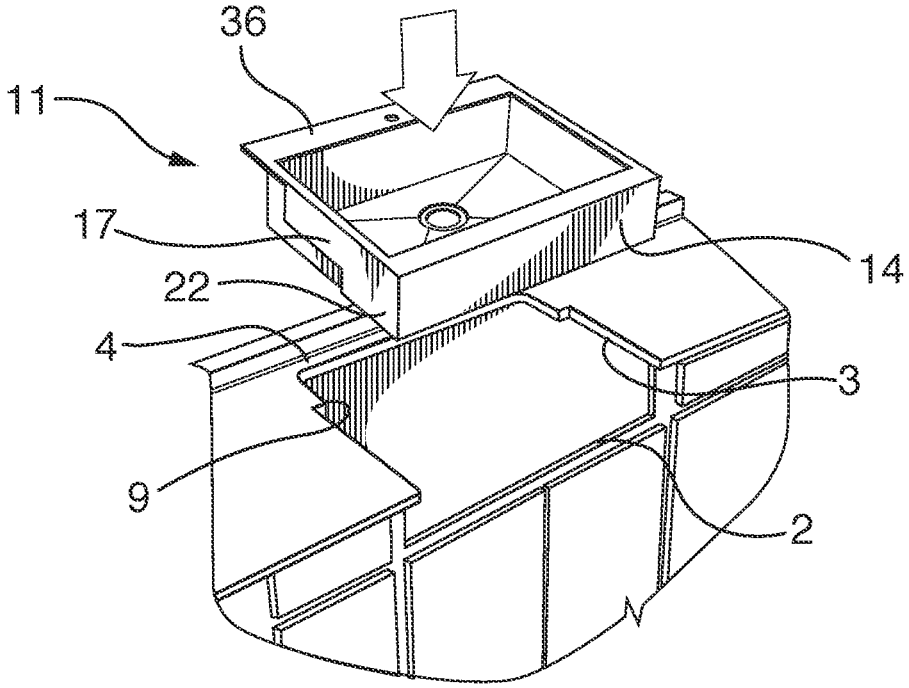
FIG. 18 shows an perspective view of the installation of a sink as shown in FIG. 1 in a cabinet including a cutaway portion of the counter top whereby the rear and side rims of the counter top rests on the counter top and the front apron is supported by the cabinet cross member support over the doors.
Figure 19:
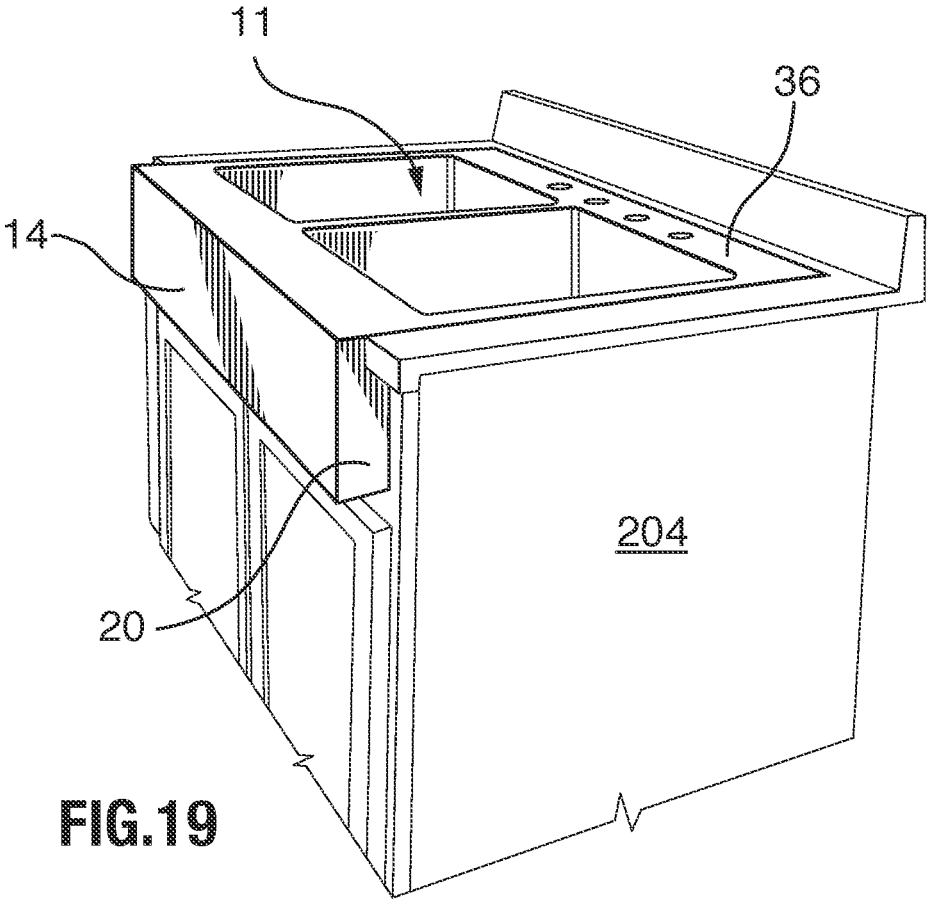
FIG. 19 is a right perspective view of the cabinet shown in FIG. 18, wherein the top drawers and front counter top have been removed and replaced with an apron sink installed in a cabinet showing a front portion of the sink "the apron" extending outward in front of the vertical front surface of the cabinet and doors extending past the front edge of the counter top.
Figure 20:
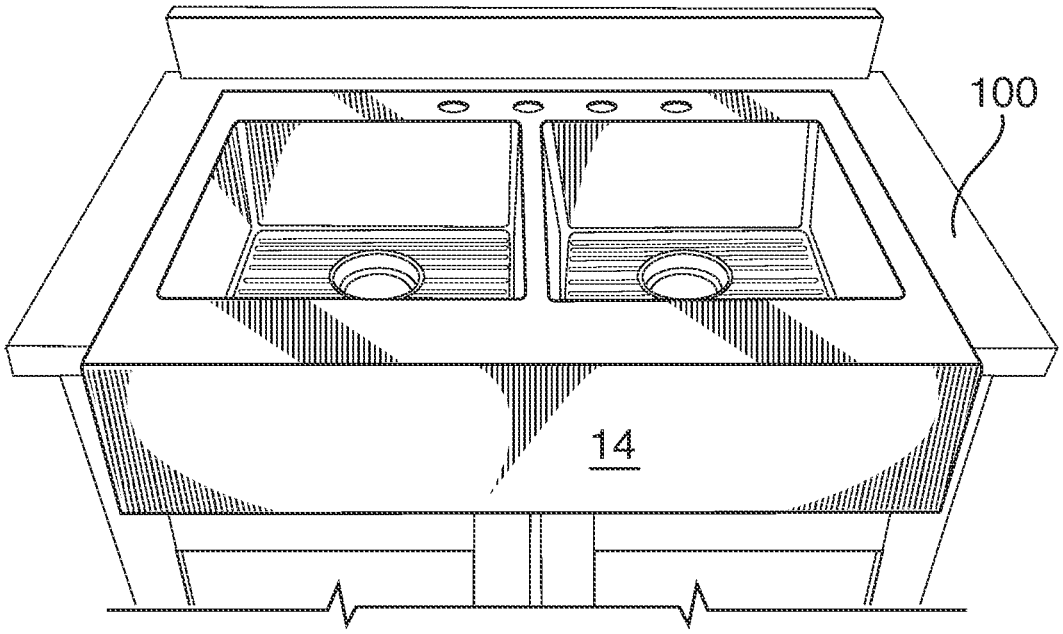
FIG. 20 is a front perspective view of the apron sink installed in a cabinet showing the front portion of the sink extending over the cabinet doors.
Figure 21:
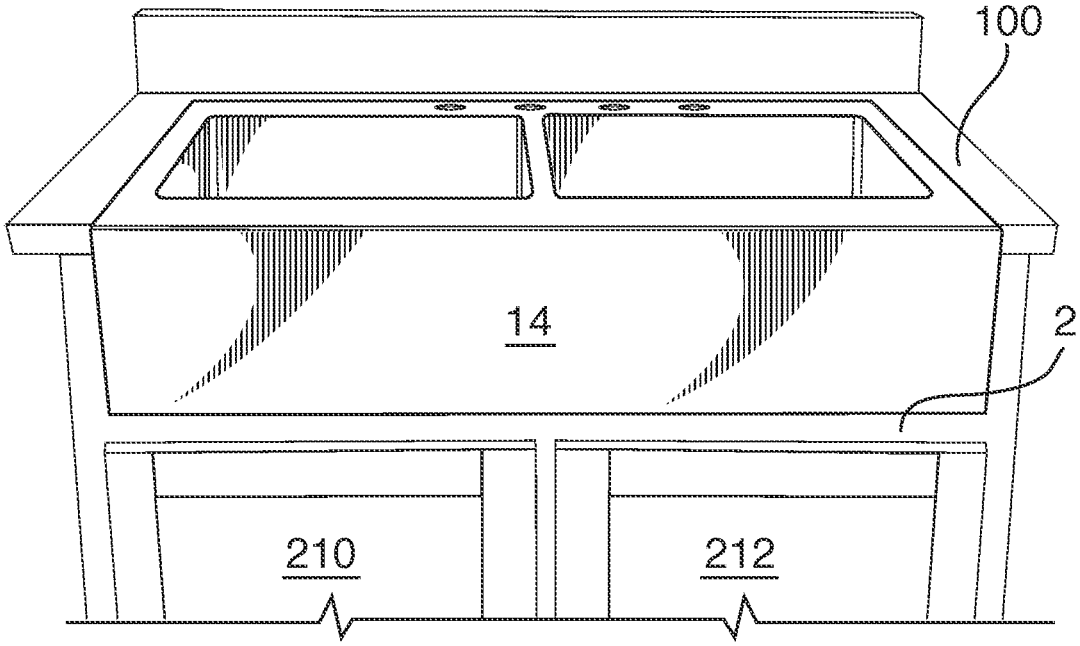
FIG. 21 is a front view of the cabinet and apron ink shown in FIG. 20 showing the rear rim of the sink supported by the counter top and the front portion of the apron sink supported by the cabinet cross member.
Figure 22:
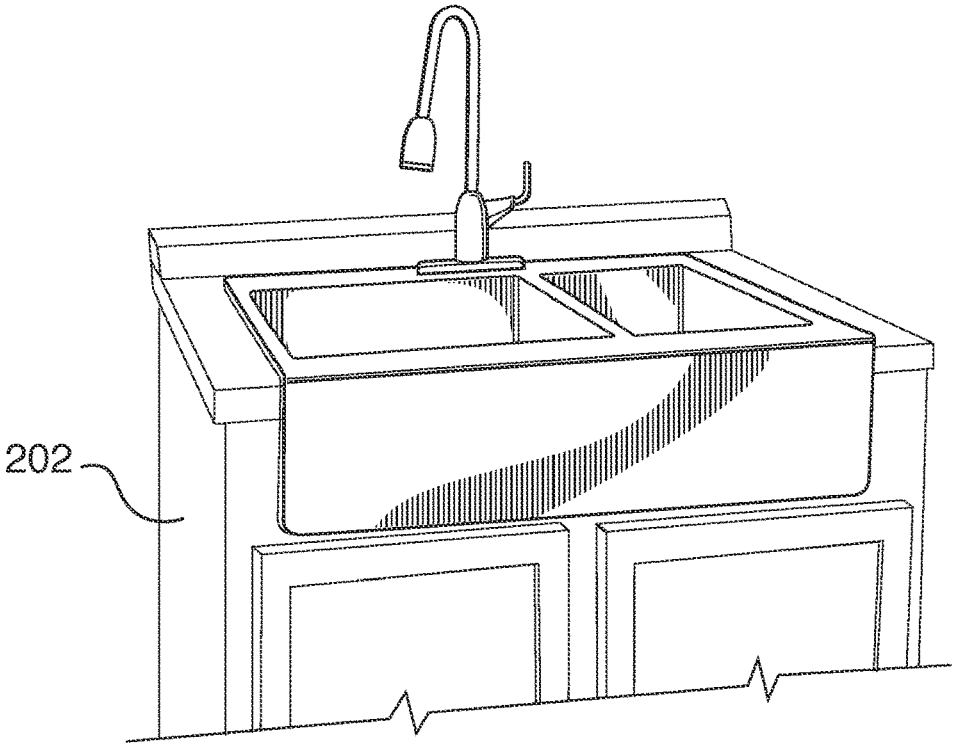
FIG. 22 is a perspective view showing an apron sink installed in a conventional cabinet in accordance with the present invention.

An optional U-channel 6 extending along a selected portion of the rear rim bottom surface 136 and/or the left side rim bottom surface 135 and/or the right side rim bottom surface 137. The U-channel 6 is of a selected length and is spaced apart from the rim edge a selected distance so that the rim rests on the top of the counter top and the U-channel is mounted beside the counter top edge and extends slightly below the bottom surface of the counter top. The open side of the U-channel 6 faces downward for cooperative engagement with a mounting clip 70. As shown in FIGS. 9-13, a conventional mounting clip 70 is generally u-shaped and includes an elongated distal end upturned and outwardly extending lip 78 and a inwardly extending opposing end having one or more prongs 76 for gripping the bottom surface of the counter top 100 as shown in FIG. 17. The mounting clip 70 also includes a pair of spaced apart opposing holes 72 and 74 aligned for cooperative engagement with the flights 86 of a threaded member or screw 82 including a conical shaped head 84 for cooperative engagement with the longitudinal flanges 8 of the U-channel 6 and includes an means for rotating the screw on the opposing end such as a slot 88. The sink shown in FIG. 13 is supported on the sides and rear by an underside surface of rim so that the rim rest on top of a counter top 100. The counter top 100 is typically one and ½ inches in thickness.

Extending downward from the front edge of the front rim 38 is the front panel 14 of the apron 20 of the apron sink 10. The front panel 14 of the apron extends laterally from the left end to the right end of the edge of the front rim 38. The vertical height of the front panel 14 is a selected height based on the dimensions of a given cabinet intended to hold the sink. The height of apron varies depending on the application and typically extends downward 6 inches to 9 inches. The height of apron panel may depend on factors such as the size of the opening from a false drawer front that the apron needs to conceal, the available space between the tops of the doors and the top of the cabinet.

Extending horizontally rearward from the bottom side edge of the front panel 14 is the bottom apron flange 25 extending from the lower right corner 114 to the lower left corner 115 of the front panel 14. The bottom apron flange 25 extends rearward from the bottom edge 116 of the front panel 14 for a selected distance based on the dimensions of the cabinet intended to hold the sink and/or the desired distance the apron side panels 22, 23 extends pass the cabinet and/or the distance from the front apron panel 25 to the cabinet front cross member 2. Moreover, the bottom apron flange 15 may extend to the floor 34 of the sink or include at least one and preferably a plurality of support strips 120 connecting the floor of the sink with a rear edge 117 of the bottom apron flange 25 whereby the bottom apron flange 25 and/or the support strips 120 rest on the front cabinet cross member 2 to support the front portion of the apron sink 10.

The back side of the apron sink 10 defines a recess or cavity to reduce the weight of the panel. The apron sink is supported by the cabinet horizontal front cross member or rail 2 rather than being cantilevered which places a load on top flange which facilitates positioning apron front panel 14 farther forward and providing better access to the sink by a user.

Extending downward from the outer edge of the right side rim 37 is the right side flange 23 of the apron sink 10. The right side flange 23 extends laterally from the right side edge of the apron front panel 14 a selected distance rearwardly and is contiguous with the outer edge of the right side rim 37. The first front portion 16 of the side flanges 22, 23 of the apron 20 extends downward from the outer edge of the right side rim 37 to the bottom apron flange 25 and a second rear step portion 17, 18 of the side flange 22, 23 extends downward a selected depth and rearwardly a selected distance toward the rear rim 36 forming a stepped side flange.

Extending downward from the outer edge of the left side rim 35 is the left side flange 22 of the apron sink 10. The left side flange 22 extends laterally from the left side edge of the apron front panel 14 a selected distance rearwardly and is contiguous with the outer edge of the left side rim 35. The first front portion 16 of the left side flange 22 of the apron 20 extends downward from the outer edge of the left side rim 35 to the bottom apron flange 25 and a second portion 18 of the right side flange extends downward a selected distance and rearwardly a selected distance toward the rear rim 36 forming a step.

Figure 5:
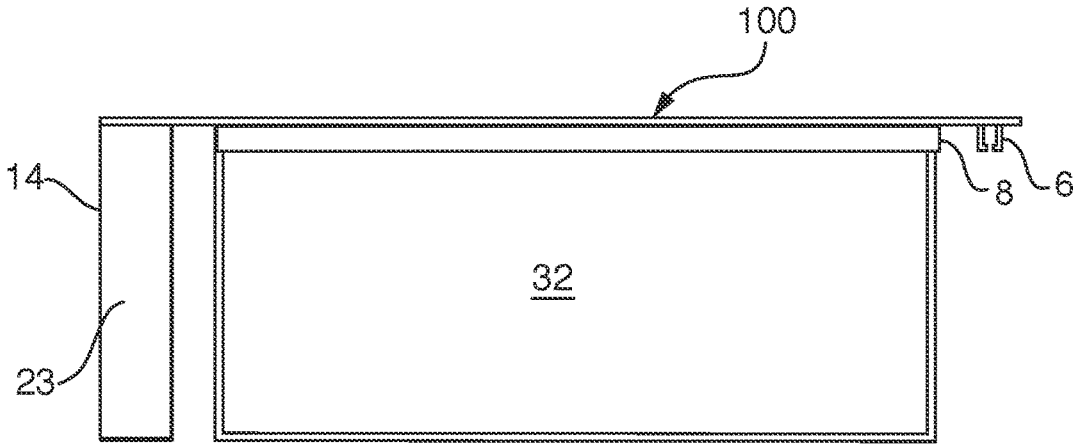
FIG. 5 is a right side view showing an apron sink with a short apron side flange extending the depth of the sink and showing the side and rear U-channels.
Figure 6:
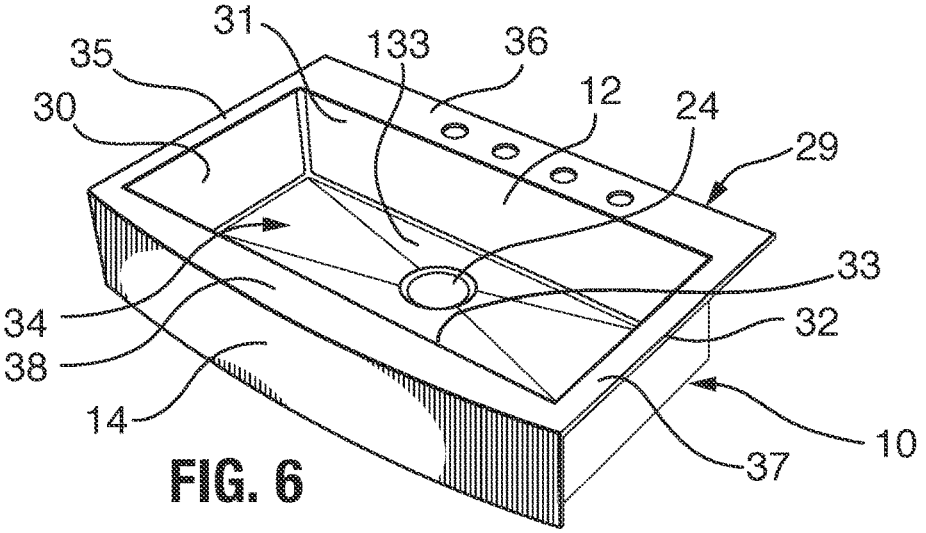
FIG. 6 is a perspective view showing an apron sink with no side flange whereby the front of the apron sink is flush with the front of the cabinet.
Figure 7:
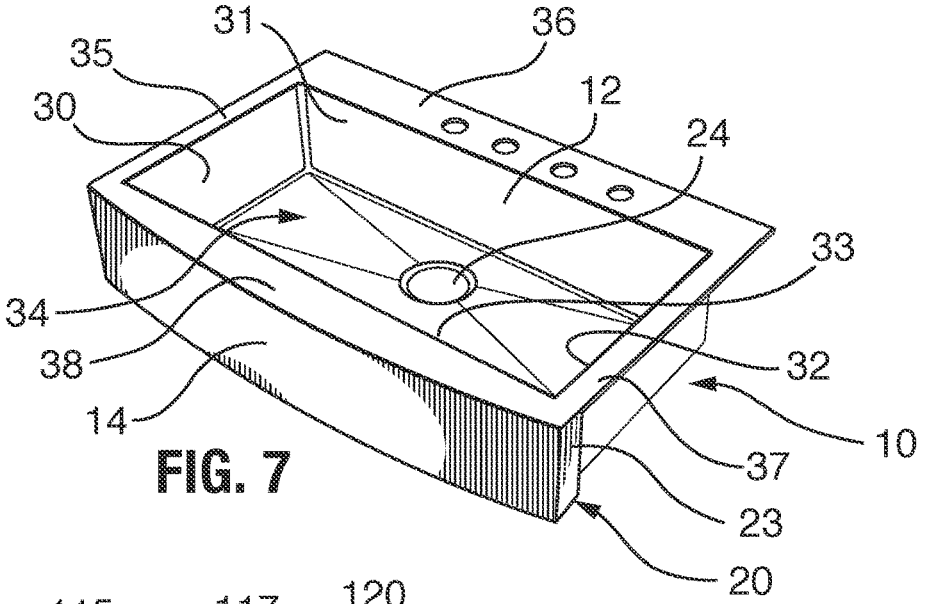
FIG. 7 is a perspective view showing the apron sink of FIG. 5 with a short side flange extending the depth of the sink.
Figure 8:
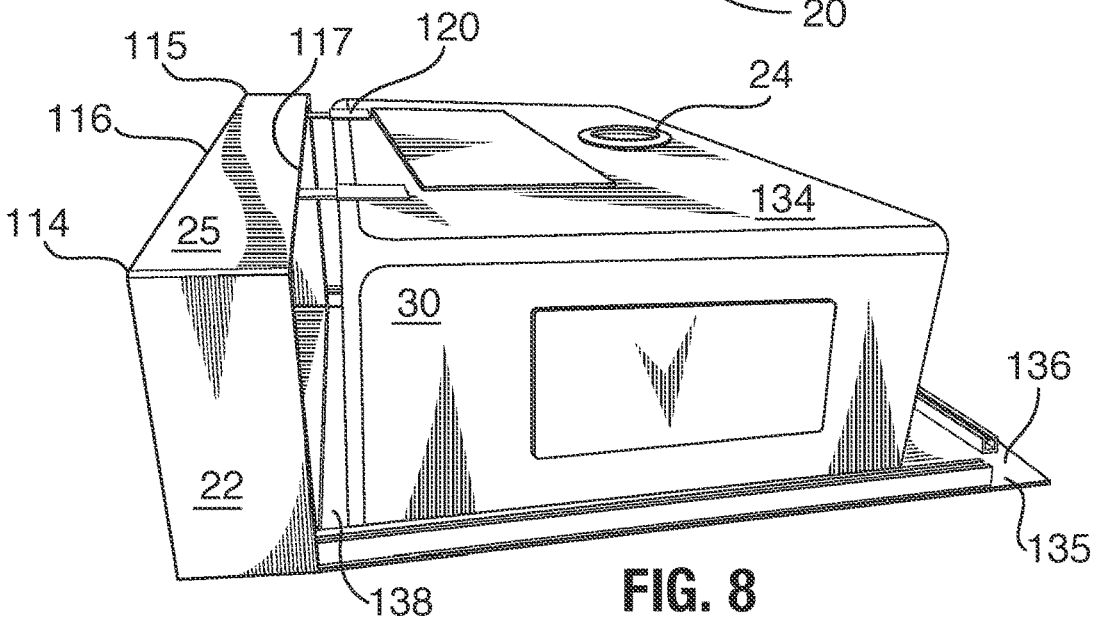
FIG. 8 is a bottom perspective view of the apron sink of FIG. 5 showing the U-channel on the bottom surface of the right side rim and bottom surface of the rear rim and support strips connecting the floor of the sink with a rear edge of the bottom apron flange.
Figure 9:
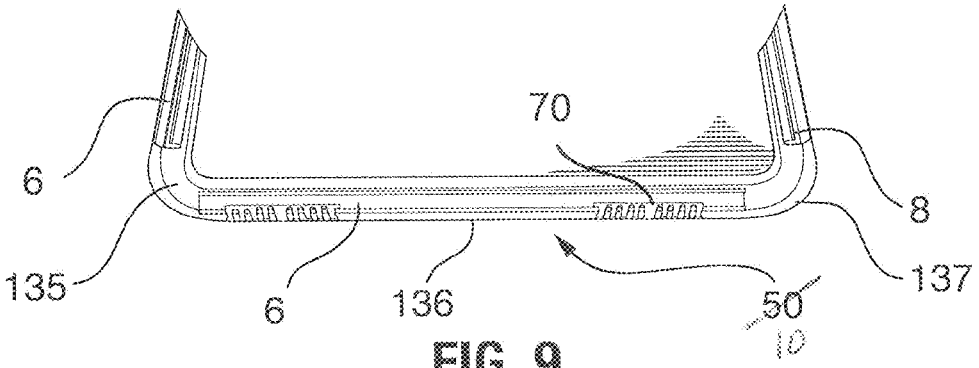
FIG. 9 is a bottom view of a fastening mechanism for a sink installation showing a plurality of clips which may be used to cooperatively engage a U-channel attached to the bottom surface of the rear and side rims of the sink to be used in combination with the cabinet support cross member for support of the apron sink without the use of any horizontal side support members.
Figure 10:
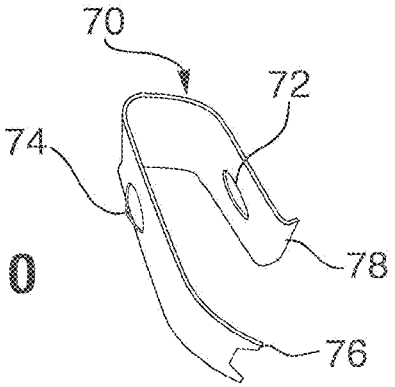
FIG. 10 is a perspective view shows an attachment clip for cooperatively engaging the bottom surface of the counter top and cooperative engagement with the U-channel on the bottom of the sink rim and the retaining screw.
Figure 11:
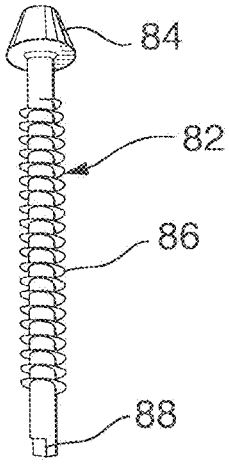
FIG. 11 is a perspective view showing a threaded retainer screw for holding the U-channel to the attachment clip.
Figure 12:
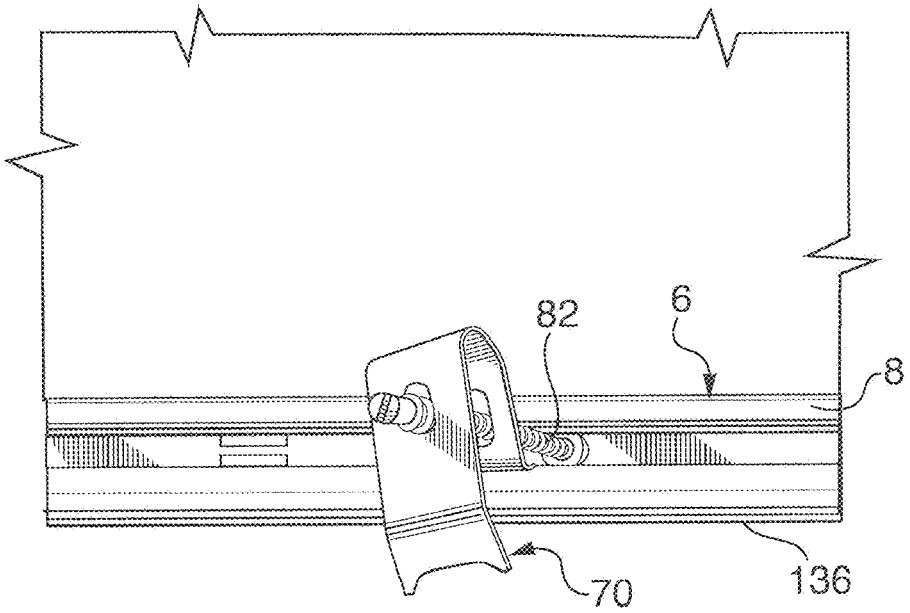
FIG. 12 is a perspective view showing the retainer screw held by the flanges of the U-channel and the clip extending outward past the edge of the sink rim to cooperatively engage the bottom of the counter top.
Figure 14:
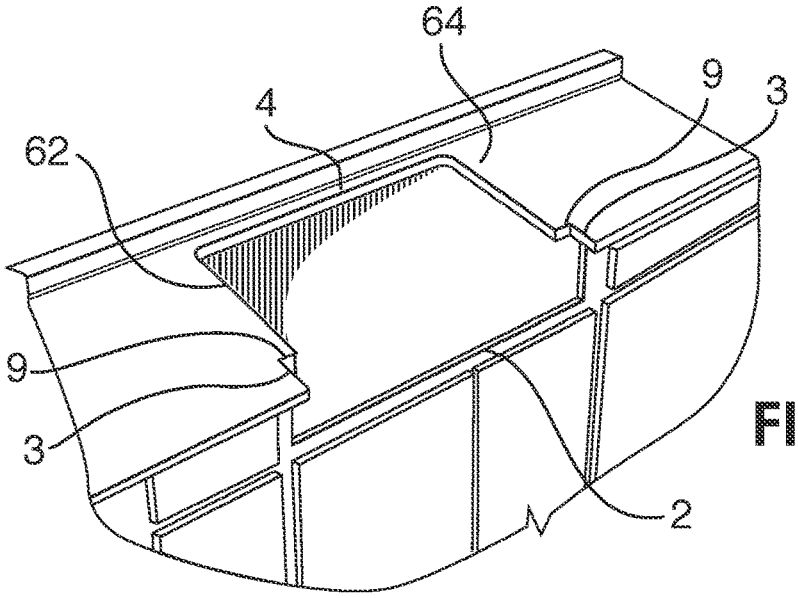
FIG. 14 is a perspective view of a cabinet showing prepared for cooperatively engaging the apron sink of FIG. 1 showing the cabinet cross support member for supporting the apron sink and notches cut in the cabinet top to accommodate a short apron side flange on each side of the apron.
Figure 15:
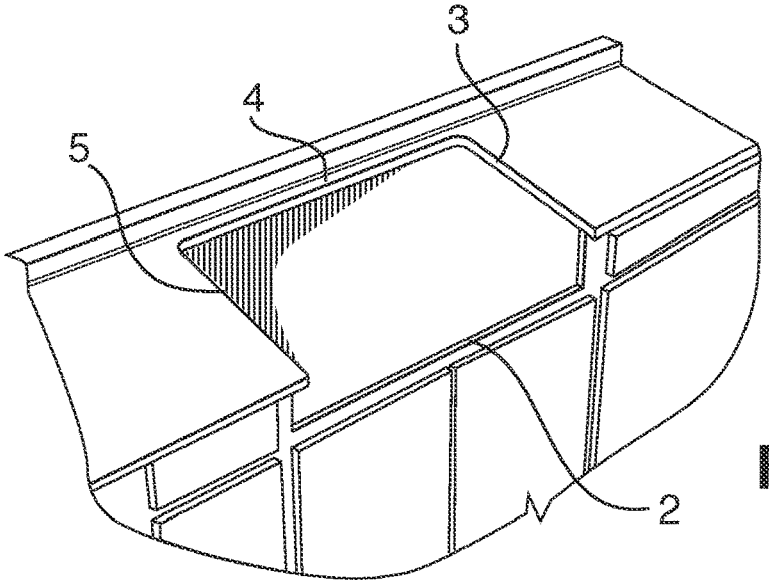
FIG. 15 is a perspective view of a cabinet showing the counter top cut out for installation of an a apron sink as shown in FIG. 6 without side flanges.
Figure 16:
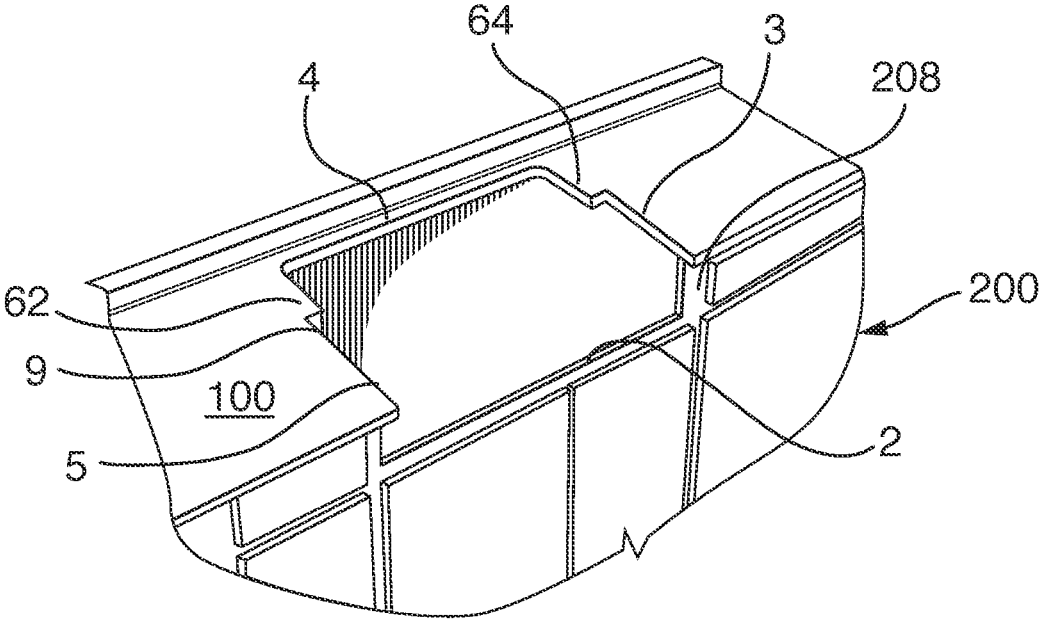
FIG. 16 is a perspective view of a cabinet prepared for installation showing a cross member extending between the sides of the cabinet above the doors for supporting a front bottom portion of the apron sink inserted into the opening cutaway in the cabinet counter top and showing the notches cut in the cabinet counter top to abut the ends of the long apron side flanges of the sink shown in FIG. 1.

The counter top template is used to cut the front portion of the counter top at a selected wider width to accommodate the opposing side flanges 8 and 9 forming notches 102 and 3 in the counter top. As shown in FIGS. 14 and 15, the notches correspond in length to fit an apron sink having a short aprons side flange as shown in FIGS. 5, 7 and 8. As shown in FIGS. 16, the notches correspond in length to fit an apron sink having longer apron side flanges as shown in FIGS. 1, 3, 13, and 18. FIG. 17 does not include a notch and cooperatively engages an apron sink having an apron front panel 14 which fits flush with the cabinet surface 208.

The front panel 14 of the apron in the sink of FIG. 1 can be straight or curved forming a apron panel 14 that is convex or rounded from side to side. The choice of flat or curved apron is purely a matter of choice.

Figure 24:
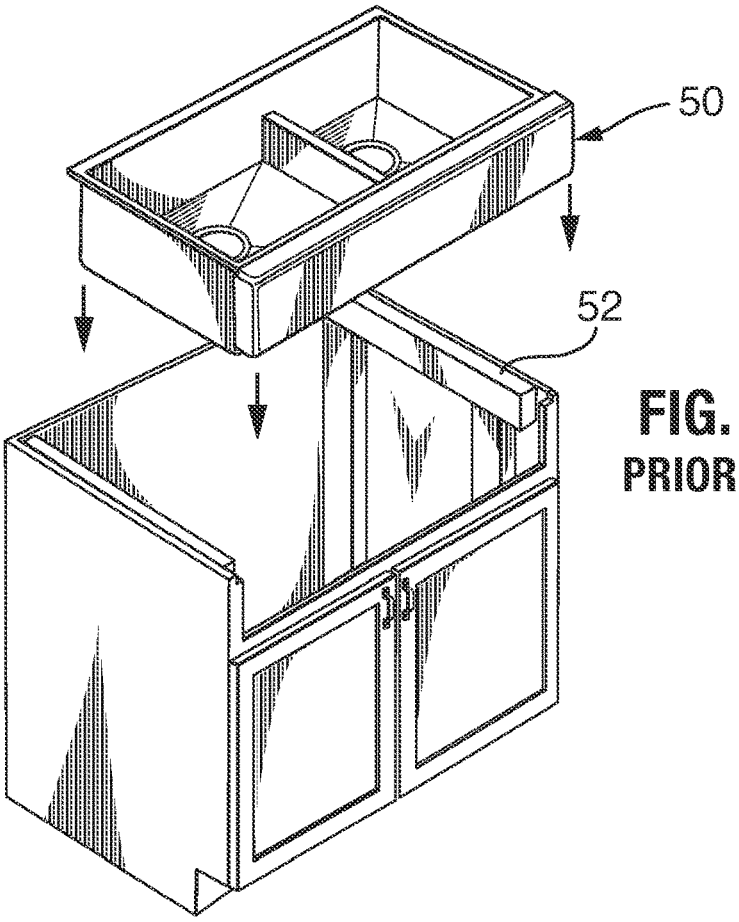
FIG. 24 PRIOR ART
FIG. 24 is a perspective view of a cabinet showing installation of an apron sink into cabinet whereby the sink is supported by side members and the apron face overlaps the front side edges of the cabinet.
Figure 25:
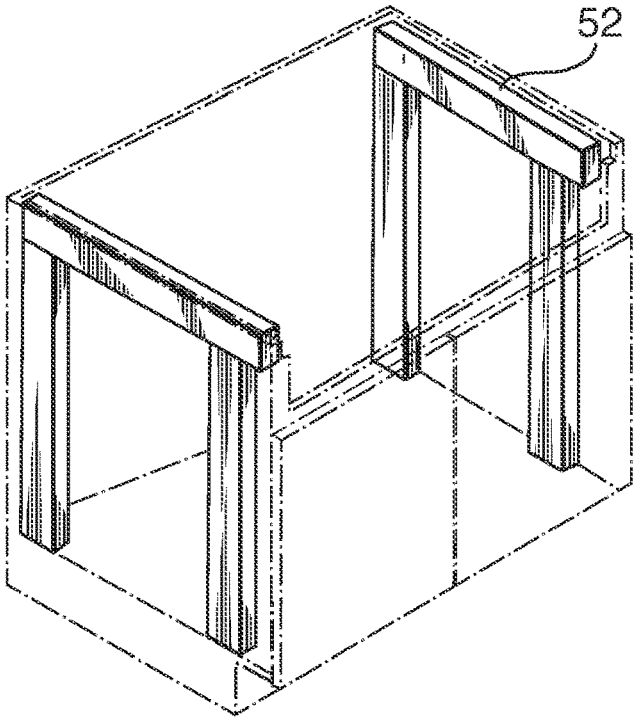
FIG. 25 PRIOR ART
FIG. 25 is a perspective cutaway view of FIG. 24 showing the addition of the side supports used to support the side edges of the prior art apron sink installation and removal of the cabinet front cross member.

The sink 50 of the prior art shown in FIGS. 24 and 25 are intended to be attached to the counter top at the sides and rear and include side support members 52. The sinks of the present invention include the left and right side flanges 22 and 23 of the apron sink which slide inside the counter top opening and are not necessary for vertical support.

Figure 23:
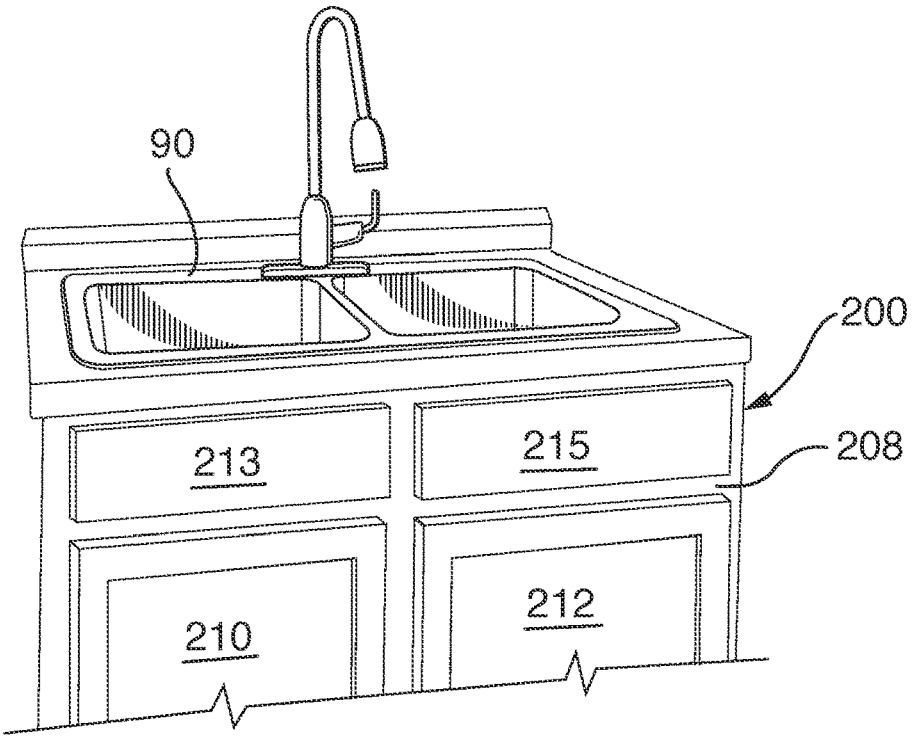
FIG. 23 PRIOR ART
FIG. 23 is a perspective view showing a conventional prior art sink and cabinet.

In accordance with FIGS. 14-22, an existing sink such as shown in FIG. 23, is modified by removing the sink and using a template to modify the cabinet and counter top to cooperatively engage the apron sink.

The cabinet 200 comprises a standard or stock cabinet about 30-48 inches in width; however, the cabinet can be of any dimension which accepts a standard sink. The cabinet includes a left panel or wall 202 and opposite right panel or wall 204. The cabinet 200 typically includes a rear panel or wall 206 adjacent to both left panel 202 and right panel 204. The cabinet includes a front panel or wall 208 and at least one door and typically a left door 210 and right door 212, movably disposed on a lower portion of front panel 208 with pivotal hinges. The front panel includes at least one and typically two apertures defining drawer openings above the doors 210 and 212 for receiving one or more doors which slidably couple to cabinet 200 or the cabinet 200 may include one or more false drawer panels 213, 215 which cover the drawer openings. The instant invention requires the front panel 208 to include a horizontal top cross member or cross rail 2 extending across a top front portion of cabinet 200 above the doors 210, 212 and below the drawer panels 213, 215. The cabinet top 200 includes a sink cut-out opening having a rear edge 4, a left rear side edge 62 and right rear side edge 64. As shown in FIG. 16, a notched flange 9 joins the front and rear side extends inwardly a selected distance from the rear edge 4 to abut the rear end edge of side flanges 22 and 23. The left and right side edges may include an additional narrow cut-out forming right front side edge 3 and left front side edge 5 extending from the notched flange 9 to the front edge of the counter top to accept the side flanges 22 and 23 extending from the apron side edge or selected sinks.

The existing sink 90 is removed from cabinet 200. If cabinet 200 includes one or more drawers received in drawer openings, or if cabinet 200 includes one or more false drawer panels, the drawers and/or the false drawer panels should be removed from cabinet 200. A vertical cut in front panel 208 is made at a selected distance from the left side and right side panels 202 and 204 from the top of the front panel to the top of the front cross member 2. No side supports or center supports extending from the front panel to the rear panel are necessary to support the apron sink which is support by the front cross member 2 and the side and end edges of the counter top 100.

One preferred method for installing the apron sink 10 into a cabinet with an existing sink is as follows:

1. Remove the existing sink;
2. Remove the false drawer fronts and the top rail so that only the horizontal cabinet front cross member or rail 2 which forms the under sink door frame remains;
3. Trim the existing opening in the counter top on the right and left sides to a width on about one-sixteenth inch wider than the distance from the outside lateral surface of the right side flange 23 to the outside lateral surface of the left side flange 22;
4. Place a one-quarter inch bead of plumbers putty on the top surface of the rear edge 4 of the opening;
5. Place a one quarter inch bead of silicone caulk on the center of the top side of the cabinet cross member rail 2 in the opening;
6. Place the sink in the opening with the bottom surface of the rear rim 36 resting on the rear edge 4 of the opening;
7. Place the bottom side 25 or the support strip 120 of the apron 20 on top of the cabinet cross member rail 2 in the opening; and
8. Apply a bead of silicone caulk to the junction of the apron and the counter top on both the left and the right sides.

The counter top 100 is cut to cooperatively engage the apron sink depending upon whether the apron sink 10 includes side flanges extending rearward from the outside edges of the apron front panel 14.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims. Accordingly, this invention is not intended to be limited by the specific exemplification presented herein above. Rather, what is intended to be covered is within the spirit and scope of the appended claims.

I claim:

1. A method of replacing a conventional sink comprising the steps of:

selecting an apron sink having at least one basin including a left wall, a rear wall, a right wall, and a front wall connecting to a bottom, said left wall having a left rim extending horizontally outward from a top edge of said left wall, said rear wall having a rear rim extending horizontally outward from a top edge of said rear wall, said right wall having a right rim extending horizontally outward from a top edge of said right wall said rear rim having a selected number of apertures formed therein for mounting plumbing fixtures, a bottom surface of said rear rim having an inverted U-channel of selected length running along an outer edge of said rear rim, with an open side of said U-channel facing downward, said front rim having an apron extending downward covering said front wall of said basin and extending laterally from a left rim edge to a right rim edge, said apron having a bottom flange extending horizontally rearward a selected width, said right rim extending downward adjoining a right edge of said apron forming a right side flange extending laterally rearward a selected length and spaced apart from said right side wall, said left rim extending downward adjoining a left edge of said apron forming a left side flange extending laterally rearward a selected length and spaced apart from said left side wall;

removing said conventional sink from a cabinet, said cabinet including at least a left panel, a right panel, and a front panel supporting a counter top, said cabinet including at least one drawer front in said front panel and having a horizontal cross member extending across said cabinet from said left panel to said right panel beneath said drawer front;

removing said drawer front;

trimming an existing opening in said counter top and said front panel to a selected width wider than a distance defined by an outer lateral surface of said right and said left side flange;

placing said apron sink in said opening with said bottom surface of said rear rim resting on a rear edge of said opening with said u-channel pressed against said rear edge of said opening;

placing said bottom flange of said apron on top of said horizontal cross member; and placing said apron sink in said opening with said bottom flange resting on said horizontal cross member.

2. The method of replacing a conventional sink of claim 1, including the step of using clips and fasteners to attach said U-channel to said counter top.

3. The method of replacing a conventional sink of claim 1, comprising the step of positioning said apron so that a front surface of said apron extends flush with or outwardly past a front plan surface of said front panel of said cabinet face after installation.

4. A method of replacing a conventional sink comprising the steps of:

selecting an apron sink having at least one basin including a left wall, a rear wall, a right wall, and a front wall connecting to a bottom, said left wall having a left rim extending horizontally outward from a top edge of said left wall, said right wall having a right rim extending horizontally outward from a top edge of said right wall, said front wall having a front rim extending horizontally outward from a top edge of said front wall, said rear wall having a rear rim extending horizontally outward from a top edge of said rear wall and having a selected number of apertures formed therein for mounting a plumbing fixture, said front rim having an apron extending downward covering said front wall of said basin and extending laterally from a left rim edge to a right rim edge, said apron having a bottom flange extending horizontally rearward a selected width, said right rim extending downward adjoining a right edge of said apron forming a right side flange extending laterally rearward a selected length and spaced apart from said right side wall, said left rim extending downward adjoining a left edge of said apron forming a left side flange extending laterally rearward a selected length and spaced apart from said left side wall;

removing the conventional sink from a cabinet, said cabinet including at least a left panel, a right panel, and a front panel supporting a counter top, said cabinet including a horizontal cross member extending across said cabinet from said left panel to said right panel beneath said conventional sink;

cutting an opening of a selected width and depth in said counter top forming a left front side edge and a right front side edge extending from a front edge of said counter top for cooperative adjacent engagement with said left side flange and said right side flange;

trimming said opening in said counter top wider than a distance defined by an outer lateral surface of said left side flange and said right side flange;

making a vertical cut in said front panel corresponding to a width of said apron sink wider than a distance defined by said outer lateral surface of said left side flange and said right side flange; and placing said apron sink in said opening whereby said bottom flange of said apron rests on a top surface of said horizontal cross member and a bottom surface of said rear rim rests on a rear edge of said opening in said counter top and an inverted U-channel extending from a bottom surface of said rear rim is pressed against said rear edge of said opening whereby said apron sink is mounted in said cabinet.

5. The method of replacing a conventional sink of claim 4, including the step of attaching said inverted U-channel to the bottom surface of said rear rim of said apron sink for cooperative engagement with said rear edge of said opening of said counter top.

6. The method of replacing a conventional sink of claim 5, including the step of using clips and fasteners to attach said U-channel to said counter top.

7. The method of replacing a conventional sink of claim 4 including the step of removing any false drawer fronts attached to said front panel of said cabinet positioned above said horizontal cross member.

8. The method of replacing a conventional sink of claim 4 including the step of removing any drawers mounted in said front panel of said cabinet positioned above said horizontal cross member.

9. The method of replacing a conventional sink of claim 4, said front panel of said cabinet including at least one door hingedly connecting to said front panel, said horizontal cross member extending across said cabinet above said at least one door.

10. The method of replacing a conventional sink of claim 4, comprising the step of positioning said apron so that a front surface of said apron extends flush with or outwardly past a front plan surface of said front panel of said cabinet face after installation.

11. The method of replacing a conventional sink of claim 4, wherein said selected length of said right side flange extends laterally rearward from said right edge to at least two-thirds of a distance to a rear end of an outer edge of said right rim, and said selected length of said left side flange extends laterally rearward from said left edge to at least two-thirds of a distance to a rear end of an outer edge of said left rim.

* * * * *